US008936241B2

(12) United States Patent
Moore

(10) Patent No.: US 8,936,241 B2
(45) Date of Patent: Jan. 20, 2015

(54) LOW NOISE ARTICULATING SHEET GUIDE

(71) Applicant: Xerox Corporation, Norwalk, CT (US)

(72) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/845,861

(22) Filed: Mar. 18, 2013

(65) Prior Publication Data

US 2014/0265110 A1 Sep. 18, 2014

(51) Int. Cl.
*B65H 9/04* (2006.01)
*B65H 9/06* (2006.01)

(52) U.S. Cl.
CPC ..... *B65H 9/06* (2013.01)
USPC ..... 271/243; 271/230

(58) Field of Classification Search
USPC ..... 271/230, 243
See application file for complete search history.

(56) References Cited

U.S. PATENT DOCUMENTS

| | | | | |
|---|---|---|---|---|
| 3,914,041 | A * | 10/1975 | Opravil | 399/316 |
| 4,638,989 | A * | 1/1987 | Senoo | 271/227 |
| 7,308,227 | B2 * | 12/2007 | Ahn | 399/388 |
| 7,731,175 | B2 * | 6/2010 | Kang | 271/110 |

* cited by examiner

*Primary Examiner* — Michael McCullough
*Assistant Examiner* — Howard Sanders
(74) *Attorney, Agent, or Firm* — Hoffmann & Baron, LLP

(57) ABSTRACT

An articulating sheet guide is used in connection with a printing system. A primary media transport nip is disposed adjacent a media sheet source supplying a media sheet. A secondary media transport nip is downstream. A link has a front surface facing upstream, and a proximal end pivotally mounted. From adjacent the primary media transport, the link will pivot past the secondary media transport. A link pocket is disposed transversely to the process direction on the link front surface. The V-shaped link pocket is adapted to receive the media leading edge. The primary media transport nip will move the media sheet toward the link. The link pocket will receive the media leading edge. The media sheet movement will cause the link to move in an arcuate path guided by the pivotal movement of the link into engagement by the secondary media transport nip. The link pocket will release the media leading edge. The operation is nearly silent.

14 Claims, 7 Drawing Sheets

LOW NOISE ARTICULATING SHEET GUIDE

INCORPORATION BY REFERENCE

Not applicable

TECHNICAL FIELD

The presently disclosed technologies are directed to an apparatus and method that guides a media sheet along a process path, and is usable with a wide range of media while operating in relative silence, in a media handling assembly such as a printing system.

BACKGROUND

In media handling assemblies, particularly in printing systems, one problem often encountered is that certain media handling and conveying configurations are significantly noisier than others. FIG. 1 depicts a simplified view of a media path for an existing, or prior art, printing system 10. Media, usually paper 14, is transported from a media sheet source, typically a paper storage tray 12, onto a traditional nip roller based media transport 22 with nip releases. The leading edge 18 of the paper is acquired by the media transport feed nip rollers 22. The paper 14 is generally conveyed within the system in a process direction.

The media handling mechanism is a significant contributor to the print mode noise. As a sheet is fed from the paper tray 12, there are discrete events as its leading edge (LE) 18 and trailing edge (TE) 20 transition between guide surfaces 26, each having associated audible noise. In some printing systems, there may be additional guide surfaces beyond the two shown. For example, as the paper 14 first touches each guide surface 26, the paper makes a noise. There is also sliding contact between the paper surface 16 and the guide surfaces 26, as the paper moves across each guide surface, which is also a significant noise source. There is significant bending strain energy stored in the paper 14, and relatively high contact forces due to the small radii of curvature within the media path along which the paper moves. These factors have made attempts at noise reduction difficult.

In any printing system, and especially in a desktop product, its overall footprint and height need to be minimized. One outcome of this is a very compact media path in which sheets of paper 14 fed out of the paper tray 12 are forced around an approximately 35 mm diameter bend between the feed nip rollers 22 and the take-away roll (TAR) nip rollers 24.

A number of fixed guides 26 exist between the feed nip rollers 22 and the TAR nips 24, as well as an idler roll 28 on the inside of the bend. The design of these guides is a compromise between robust guidance of the paper LE 18 and control of the body and TE 20 of the paper 14. There is significant audible noise generated as the paper LE 18 transitions from one guide surface 26 to the next; as the paper LE 18 enters the TAR nip 24; as the body of the paper contacts and slides on the stationary guide surfaces 26; as the TE 20 transitions from the feed nip 22 to the next guide; and as the TE 20 transitions into the TAR nip 24. From there, the paper exits the TAR nip 24 and encounters downstream guides 26. A sample noise trace, taken by measurement during a test, is shown in FIG. 2.

The noise level in dBA of the FIG. 1 printer while feeding a sheet of paper is shown as the solid trace 'Standard Print' in FIG. 2. The dotted trace shows the noise level during a 'dry cycle' in which no paper is present. It is evident that there is significant audible energy due to the paper passing through the media path, and this has been associated with the media handling events described above. A variety of remediative methods and mechanisms have been devised and tested to reduce the overall noise level of paper and other media sheets passing through the media path, with limited success Improvements on the order of 1-3 dBA have been seen, but the goal of silencing by approximately 65 dBA has, until now, been elusive.

Accordingly, it would be desirable to provide an apparatus capable of elimination of stationary guide surfaces, thereby avoiding the problems associated with the prior art.

SUMMARY

An articulating sheet guide 30 is used in connection with a printing system. A media sheet source 34 supplies a media sheet 36 with a leading edge 42 and an opposite trailing edge 44. The articulating sheet guide 30 comprises a primary media transport 46, or feed nip, which moves the media sheet 36 in a process direction 32. The primary media transport 46 is disposed adjacent the media sheet source 34. A secondary media transport 50, or take-away roll nip, is disposed downstream of the primary media transport 46.

A link 52 has at least one elongated element 54. The link 52 has a front surface 56 facing generally upstream of the process direction 32. The link 52 extends from a proximal end 60 to a distal end 62. The link proximal end 60 is pivotally mounted for pivotal movement on a pivotal axis 64. From a starting position adjacent the primary media transport 46, the link 52 will pivot past the secondary media transport 50, to an ending position. Alternatively, the link 52 can include a plurality of elongated elements 54 spaced apart in a direction transverse to the process direction 32.

A link pocket 66 is disposed transversely to the process direction 32 on the link front surface 56. The link pocket 66 is adapted to receive the media leading edge 42. The link pocket 66 is generally V-shaped in cross-section. The link pocket 66 can be one piece or a plurality of link pockets 66.

In operation, the primary media transport 46 will move the media sheet 36 from the media sheet source 34 toward the link 52. The link pocket 66 will receive the media leading edge 42. The media sheet movement will cause the link 52 to move pivotally and silently in an arcuate path guided by the pivotal movement of the link 52 into engagement by the secondary media transport 50. The link pocket 66 will release the media leading edge 42. The link 52 will continue, by way of inertia, to pivot away from the media path. Gravity or a return spring (not shown) will cause the link 52 to return to the starting position. The main advantage of the articulating sheet guide 30 with pivoting link 52 is in nearly silent operation. This is due to the elimination of stationary guide surfaces between nips, as described above. Another advantage not anticipated or expected is enhanced accuracy and repeatability in delivering the media sheet 36 from one nip to another, with fewer paper jams.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
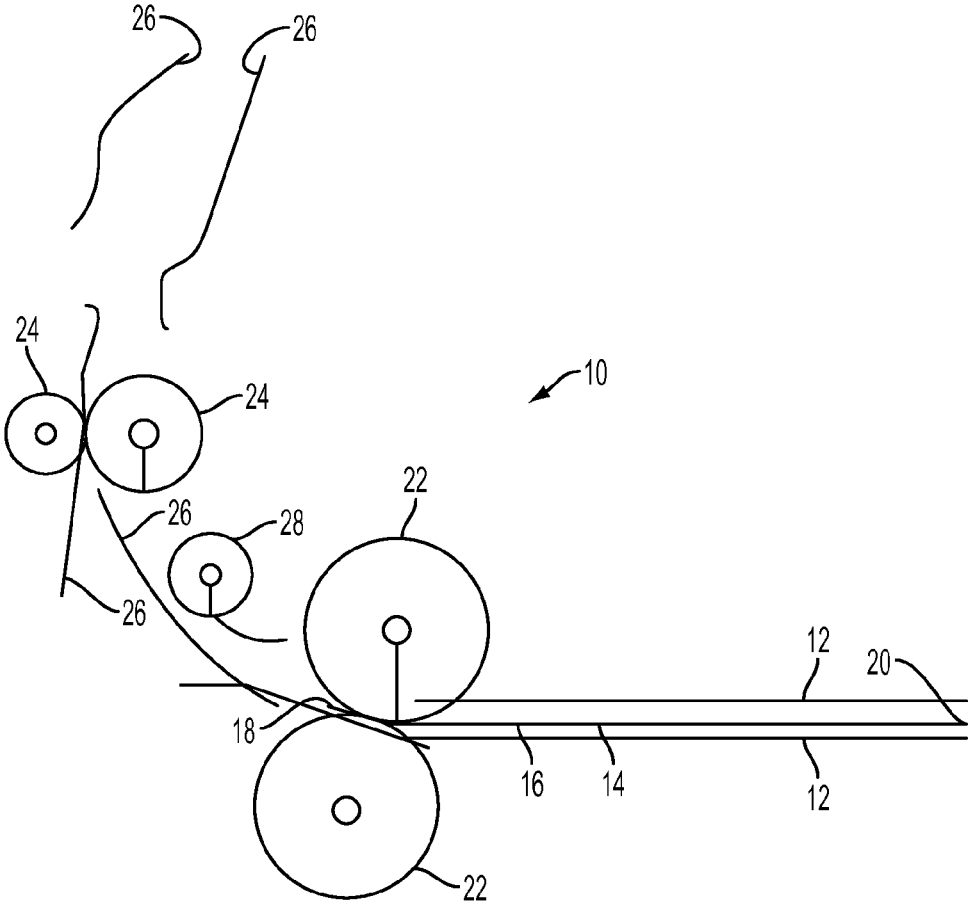
FIG. 1 PRIOR ART
FIG. 1 is a side elevational view of an existing, or prior art, production printing system that could make use of the disclosed technologies.
Figure 2:
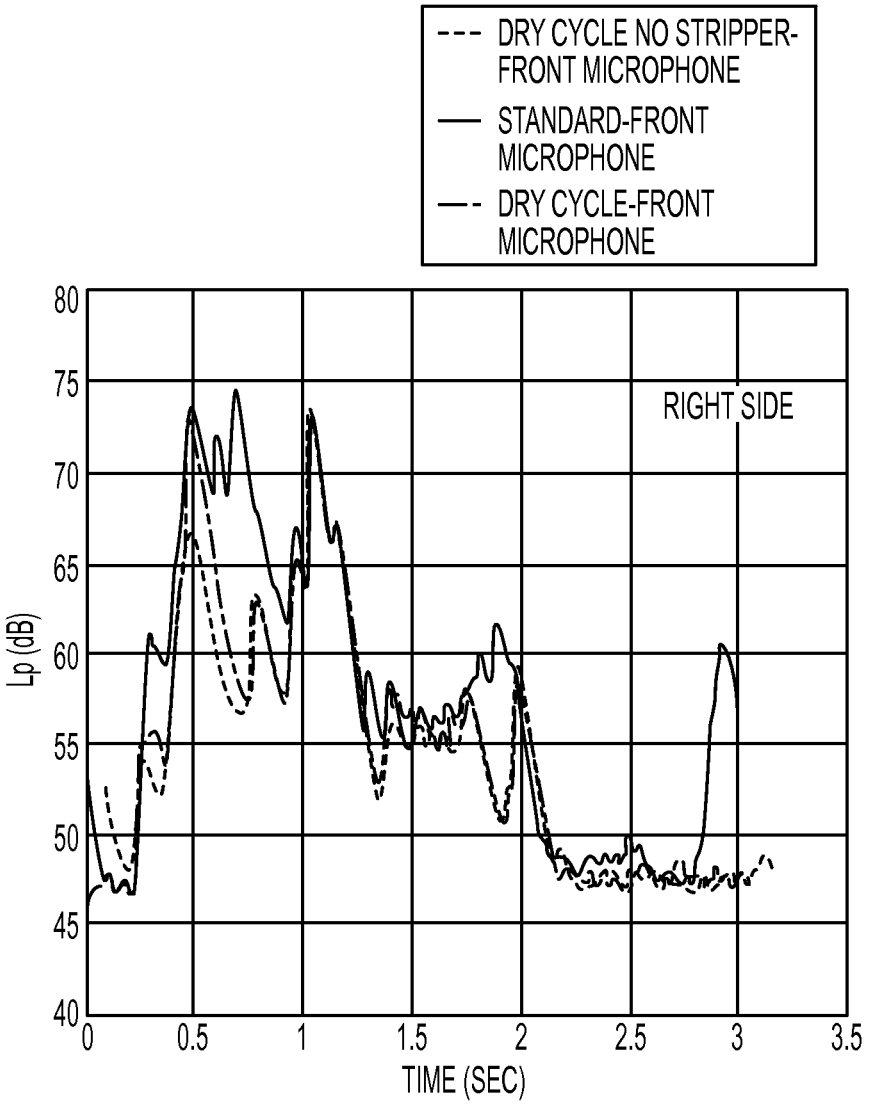
FIG. 2 is a graph plot of measured sound pressure levels of the production printing system of FIG. 1.

Describing now in further detail these exemplary embodiments with reference to the Figures as described above, the articulating sheet guide is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process," which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" and "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" of a media substrate refers to an edge of the sheet that is furthest downstream in the process direction.

As used herein, a "media handling assembly" and "media transport" refers to one or more devices used for handling and/or transporting media substrate, including feeding, printing, finishing, registration and transport systems. These include nip rollers and belts.

As used herein, the terms "process" and "process direction" refer to a procedure of moving, transporting and/or handling a substrate media. The process direction is a flow path the media substrate moves in during the process.

Referring to FIGS. 3-8, an articulating sheet guide 30 is used in connection with a printing system having a process direction shown by arrow 32. A media sheet source 34 is a tray supplying paper. A media sheet 36 has opposite top 38 and bottom 40 surfaces. The media sheet 36 has a leading edge 42 and an opposite trailing edge 44. The media sheet 36 has a predetermined width along the leading edge 42.

Figure 3:
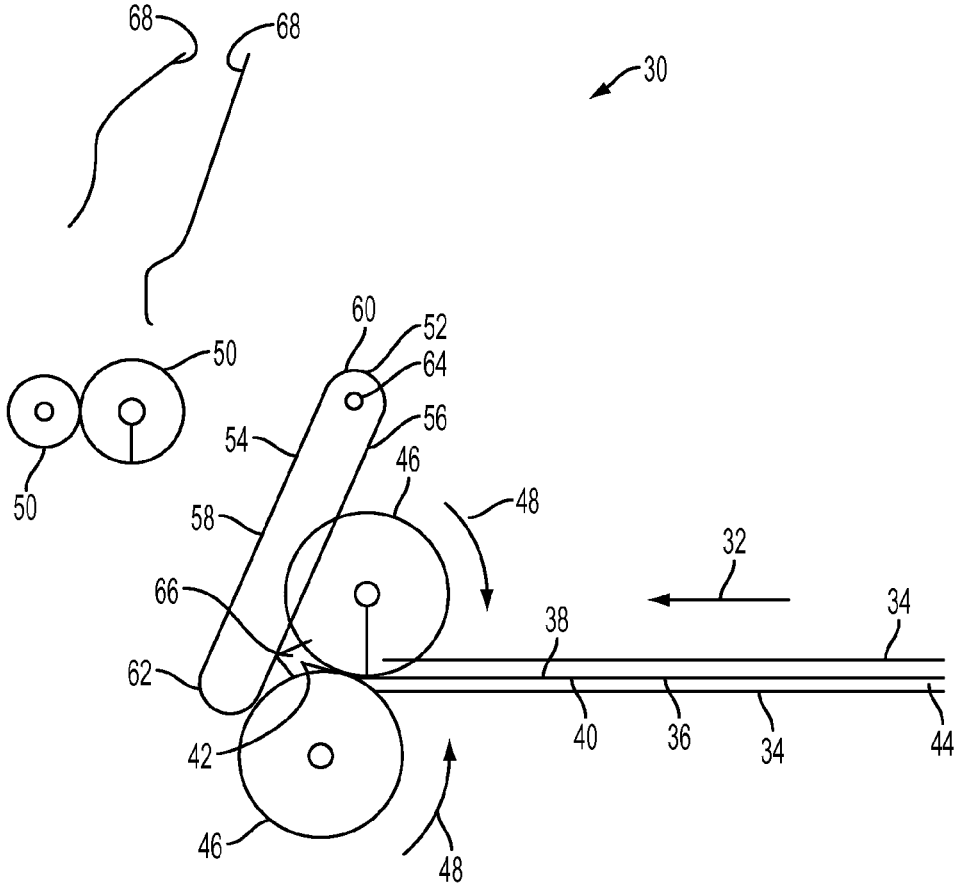
FIG. 3 is a side elevational view of a printing system using an articulating sheet guide constructed in accordance with the invention.
Figure 4:
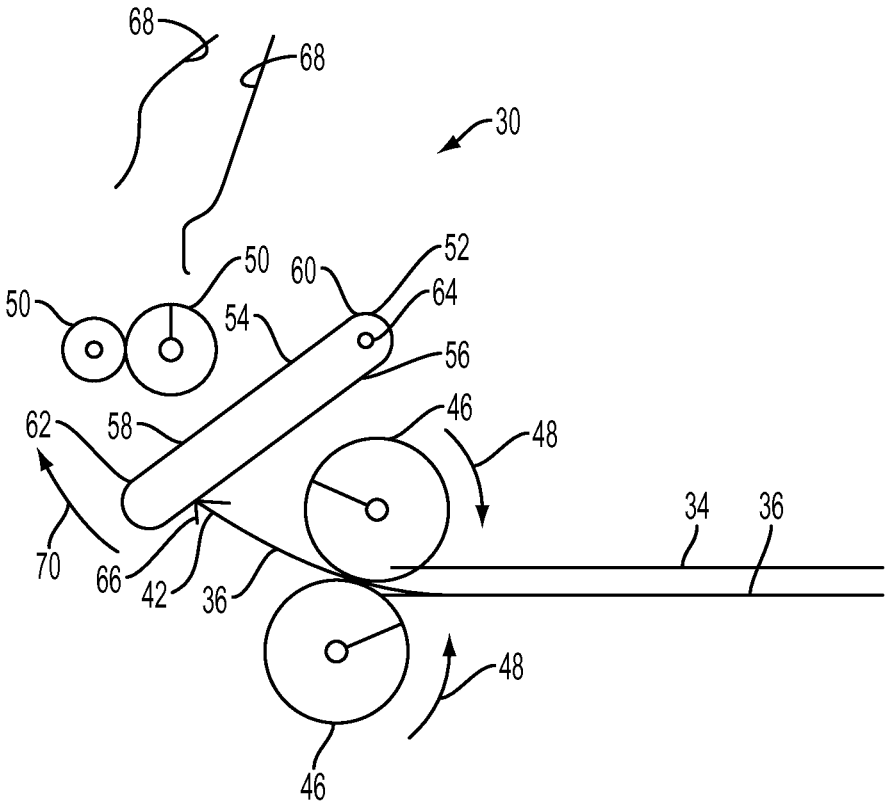
FIG. 4 is a side elevational view of the articulating sheet guide of FIG. 3 at the start of operation.
Figure 5:
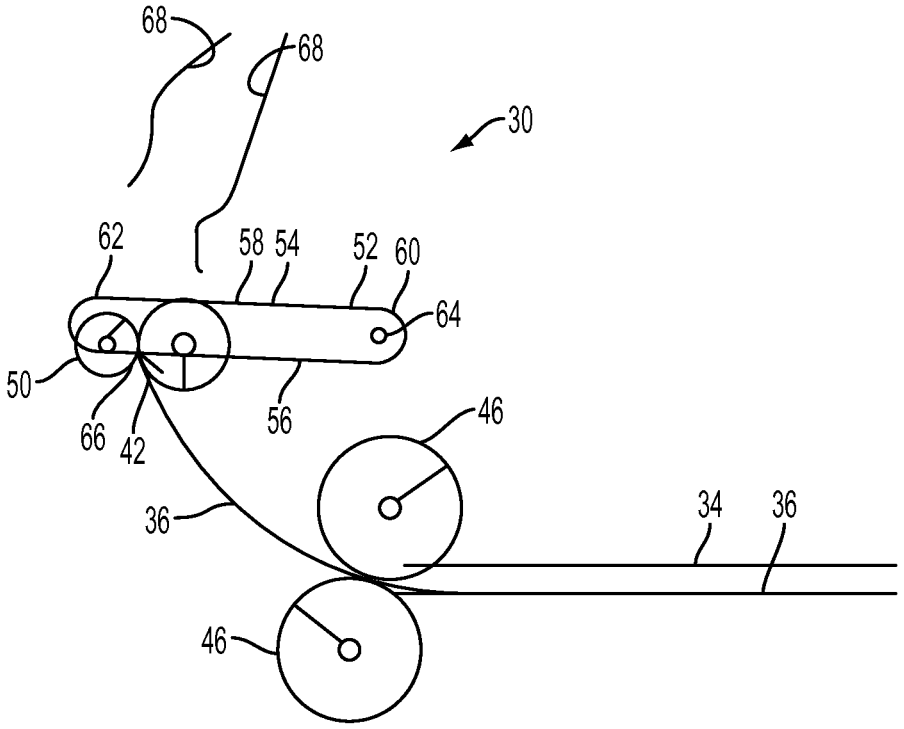
FIG. 5 is a side elevational view of the articulating sheet guide of FIG. 3 at another stage of operation.
Figure 6:
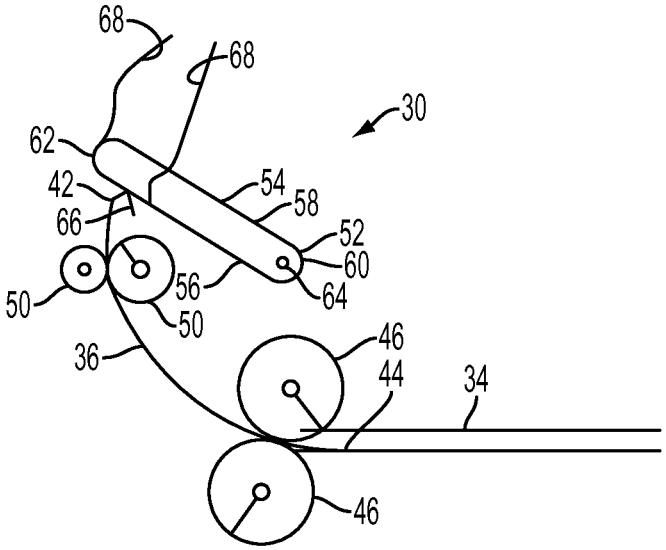
FIG. 6 is a side elevational view of the articulating sheet guide of FIG. 3 at yet another stage of operation.

The articulating sheet guide 30 comprises a primary media transport 46, which is typically a feed nip having a pair of nip rollers. The rollers turn in the direction of arrows 48 to move the media sheet 36 in the process direction 32. The primary media transport 46 is shown in FIG. 3 disposed adjacent the media sheet source 34 and starting to receive the media sheet 36. A secondary media transport 50, which is typically a take-away roll having a pair of nip rollers, is disposed downstream of the primary media transport 46.

Figure 7:
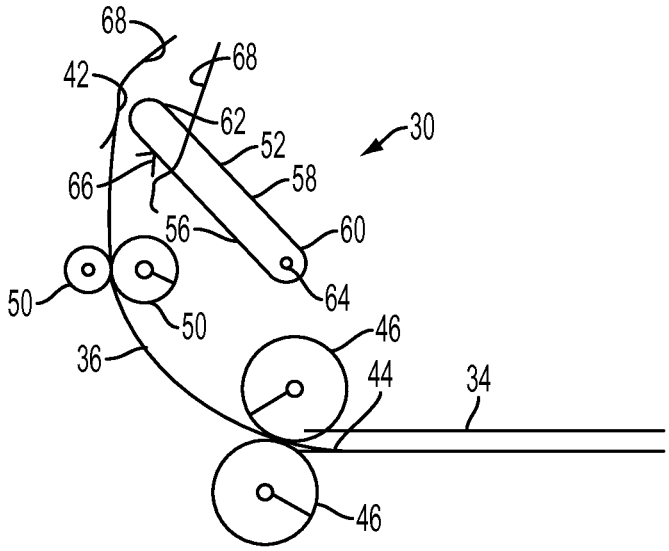
FIG. 7 is a side elevational view of the articulating sheet guide of FIG. 3 at the completion stage of operation.
Figure 8:
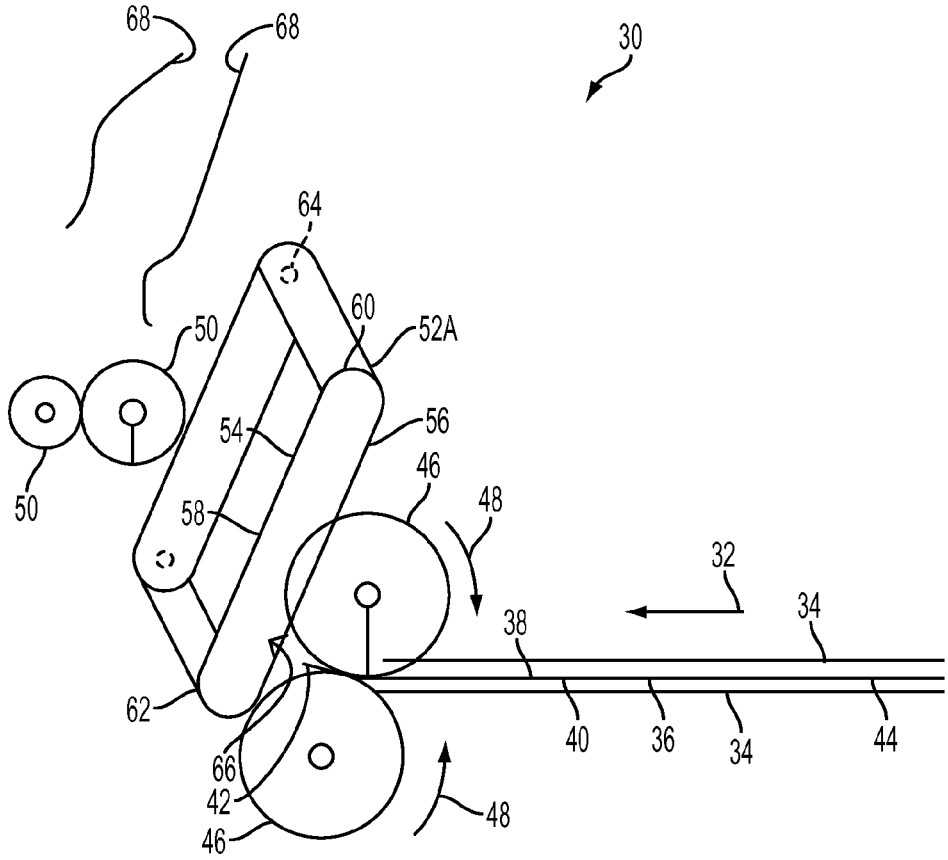
FIG. 8 is a side elevational view of a printing system using an articulating sheet guide including a four-bar linkage constructed in accordance with the invention.

A link 52 has at least one elongated element 54. The link 52 has a front surface 56 facing generally upstream of the process direction 32, and an opposite rear surface 58. The link 52 extends from a proximal end 60 to a distal end 62. The link proximal end 60 is pivotally mounted on the printing system for pivotal movement on a pivotal axis 64 of the link 52. Various alternative links and mounting configurations are possible. For example, a four-bar linkage 52A will provide a more complex arcuate path, as shown in FIG. 8. As another example, a pivot pin sliding in a slot will provide both rotational and translational motion. The embodiment shown and claimed employs a fixed pivotal axis, but alternative embodiments are possible within the spirit and scope of the claims. From a starting position adjacent the primary media transport 46 (FIG. 3), the link 52 will pivot toward the secondary media transport 50 (FIGS. 4 & 5), past the secondary media transport 50 (FIG. 6), to an ending position (FIG. 7). Alternatively, the link 52 can include a plurality of elongated elements 54 spaced apart in a direction transverse to the process direction 32.

A link pocket 66 is disposed transversely to the process direction 32 on the link front surface 56. The link pocket 66 extends across the link front surface 56 in a direction generally perpendicular to a plane of pivotal movement of the link 52. The link pocket 66 is aligned with the media leading edge 42 when the link 52 is in the starting position. The link pocket 66 is adapted to receive the media leading edge 42. The link pocket 66 is generally V-shaped in cross-section so as to receive, control, and release the media leading edge 42 during the process. The link pocket 66 can be one piece or a plurality of link pockets 66 extending in alignment across the link front surface 56 in a direction generally perpendicular to a plane of pivotal movement of the link.

In operation, the primary media transport 46 will move the media sheet 36 from the media sheet source 34 toward the link 52. The link pocket 66 will receive the media leading edge 42. The media sheet movement will cause the link 52 to move pivotally in a direction shown by arrow 70. The media sheet 36 will move relatively silently in an arcuate path guided by the pivotal movement of the link into engagement by the secondary media transport. The link pocket 66 will release the media leading edge 42. The link 52 will continue, by way of inertia, to pivot away from the media path, as shown in FIG. 7. Gravity or a return spring (not shown) will cause the link 52 to return to the starting position. At this point, the media sheet 36 has been acquired by downstream stationary guide surfaces 68, in a conventional manner. The main advantage of the articulating sheet guide 30 with pivoting link 52 is in nearly silent operation. This is due to the elimination of stationary guide surfaces between nips, as described above. Another advantage not anticipated or expected is enhanced accuracy and repeatability in delivering the media sheet 36 from one nip to another, with fewer paper jams.

A method is disclosed for guiding a media sheet between a primary media transport and a secondary media transport. The method comprises disposing a primary media transport adjacent the media sheet source; and disposing a secondary media transport downstream of the primary media transport. Then providing a link having at least one elongated element, the link extending from a proximal end to a distal end; pivotally mounting the link proximal end on the printing system for pivotal movement on a pivotal axis of the link, the pivotal axis being transverse to the process direction; and disposing a link pocket on the link front surface transversely to the process direction.

Next, moving the media sheet from the media sheet source through the primary media transport; aligning the link pocket with the media sheet; and receiving the media leading edge in the link pocket.

Next, causing pivotal movement of the link by moving the media sheet through the primary media transport; and guiding the media sheet silently in an arcuate path by the pivotal movement of the link. Then, engaging the media sheet with the secondary media transport; and releasing the media leading edge from the link pocket.

In another aspect, the method as described above, wherein the primary media transport further comprises a pair of nip rollers; the secondary media transport further comprises a pair of nip rollers; and the link pocket is generally V-shaped in cross-section.

In yet another aspect, the method as described above, further comprising extending the link pocket across the link front surface in a direction generally perpendicular to a plane of pivotal movement of the link.

In still another aspect, the method as described above, further comprising extending a plurality of link pockets in alignment across the link front surface in a direction generally perpendicular to a plane of pivotal movement of the link.

In a further aspect, the method as described above, further comprising providing a plurality of elongated elements spaced apart on the link in a direction transverse to the process direction; and extending a plurality of link pockets in alignment on the link front surface in a direction generally perpendicular to a plane of pivotal movement of the link, each elongated element having one of the link pockets.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An articulating sheet guide, for use in connection with a printing system having a process direction, a media sheet source, and a media sheet having opposite top and bottom surfaces, the media sheet having a leading edge and an opposite trailing edge, the media sheet having a predetermined width along the leading edge, the articulating sheet guide comprising:

a primary media transport adjacent the media sheet source;

a secondary media transport downstream of the primary media transport;

a link having at least one elongated element, the link having a front surface facing generally upstream of the process direction and an opposite rear surface, the link extending from a proximal end to a distal end, the link proximal end being pivotally mounted on the printing system for pivotal movement on a pivotal axis of the link from a starting position adjacent the primary media transport toward the secondary media transport to an ending position, wherein the link comprises exactly four bars; and at least one link pocket disposed transversely to the process direction on the link front surface, the link pocket being adapted to receive the media leading edge; so that the primary media transport will move the media sheet from the media sheet source toward the link, the link pocket will receive the media leading edge adjacent to the primary media transport, the media sheet movement will cause the link to move pivotally, the media sheet will move along an arcuate path guided by movement of the link pocket resulting from the pivotal movement of the link, the link pocket will guide the media sheet into engagement with the secondary media transport and, thereafter, the link pocket will release the media leading edge.

2. The articulating sheet guide of claim 1, wherein the pivotal axis of the link is generally transverse to the process direction and spaced apart from the process direction.

3. The articulating sheet guide of claim 1, wherein the primary media transport further comprises a pair of nip rollers.

4. The articulating sheet guide of claim 1, wherein the secondary media transport further comprises a pair of nip rollers.

5. The articulating sheet guide of claim 1, wherein the at least one link pocket is generally V-shaped in cross-section, so as to receive, control, and release the media leading edge.

6. The articulating sheet guide of claim 1, wherein the at least one link pocket extends across the link front surface in a direction generally perpendicular to a plane of pivotal movement of the link.

7. An articulating sheet guide, for use in connection with a printing system having a process direction, a media sheet source, and a media sheet having opposite top and bottom surfaces, the media sheet having a leading edge and an opposite trailing edge, the media sheet having a predetermined width along the leading edge, the articulating sheet guide comprising:

a primary media transport nip adjacent the media sheet source;

a secondary media transport nip downstream of the primary media transport;

a link having at least one elongated element, the link having a front surface facing generally upstream of the process direction and an opposite rear surface, the link extending from a proximal end to a distal end, the link proximal end being pivotally mounted on the printing system for pivotal movement on a pivotal axis of the link from a starting position adjacent the primary media transport toward the secondary media transport to an ending position, wherein the link comprises exactly four bars; and at least one link pocket disposed transversely to the process direction on the link front surface, the link pocket being aligned with the media leading edge when the link is in the starting position, the link pocket being adapted to receive the media leading edge, the link pocket being generally V-shaped in cross-section; so that the primary media transport will move the media sheet from the media sheet source toward the link, the link pocket will receive the media leading edge adjacent to the primary media transport, the media sheet movement will cause the link to move pivotally, the media sheet will move along an arcuate path guided by movement of the link pocket resulting from the pivotal movement of the link, the link pocket will guide the media sheet into engagement with the secondary media transport and, thereafter, the link pocket will release the media leading edge.

8. The articulating sheet guide of claim 7, wherein the pivotal axis of the link is generally transverse to the process direction and spaced apart from the process direction.

9. The articulating sheet guide of claim 7, wherein the at least one link pockets extends across the link front surface in a direction generally perpendicular to a plane of pivotal movement of the link.

10. A method for guiding a media sheet between a primary media transport and a secondary media transport, for use in connection with a printing system having a process direction, a media sheet source, and a media sheet having opposite top and bottom surfaces, the media sheet having a leading edge and an opposite trailing edge, the media sheet having a predetermined width along the leading edge, the method comprising:

disposing at least one primary media transport adjacent the media sheet source;

disposing a secondary media transport downstream of the primary media transport;

providing a link having at least one elongated element, the link extending from a proximal end to a distal end, wherein the link comprises exactly four bars;

pivotally mounting the link proximal end-on the printing system for pivotal movement on a pivotal axis of the link, the pivotal axis being transverse to the process direction;

disposing a link pocket on the link front surface transversely to the process direction;

moving the media sheet from the media sheet source through the primary media transport;

aligning the link pocket with the media sheet;

receiving the media leading edge in the link pocket adjacent to the primary media transport;

causing pivotal movement of the link by moving the media sheet through the primary media transport;

guiding the media sheet along an arcuate path by movement of the link pocket resulting from the pivotal movement of the link;

engaging the media sheet with the secondary media transport by guidance of the link pocket; and releasing, thereafter, the media leading edge from the link pocket.

11. The method of claim 10, wherein the primary media transport further comprises a pair of nip rollers.

12. The method of claim 10, wherein the secondary media transport further comprises a pair of nip rollers.

13. The method of claim 10, wherein the at least one link pocket is generally V-shaped in cross-section.

14. The method of claim 10, further comprising extending the at least one link pocket across the link front surface in a direction generally perpendicular to a plane of pivotal movement of the link.

* * * * *